US006749783B2

(12) United States Patent
Everett

(10) Patent No.: US 6,749,783 B2
(45) Date of Patent: Jun. 15, 2004

(54) TANGO II SOIL BLOCK PRESS

(75) Inventor: Steve Everett, 2819 Foster La., Apt # F234, Austin, TX (US) 78757-1143

(73) Assignee: Steve Everett, Austin, TX (US)

( * ) Notice: Subject to any disclaimer, the term of this patent is extended or adjusted under 35 U.S.C. 154(b) by 0 days.

(21) Appl. No.: 09/933,725

(22) Filed: Aug. 22, 2001

(65) Prior Publication Data

US 2002/0105107 A1 Aug. 8, 2002

Related U.S. Application Data

(60) Provisional application No. 60/266,371, filed on Feb. 5, 2001.

(51) Int. Cl.[7] ..... B28B 3/08; B28B 7/10

(52) U.S. Cl. ..... 264/109; 264/40.5; 264/297.9; 264/319; 264/334; 425/62; 425/352; 425/354; 425/436 R; 425/139; 425/149

(58) Field of Search ..... 425/62, 352, 354, 425/167, 165, 149, 139, 436 R; 264/40.5, 319, 333, 297.9, 334, 109

(56) References Cited

U.S. PATENT DOCUMENTS

| | | | | | |
|---|---|---|---|---|---|
| 2,402,367 | A | * | 6/1946 | Cantrall et al. | 425/432 |
| 2,787,040 | A | * | 4/1957 | Morelli et al. | 425/62 |
| 3,070,003 | A | * | 12/1962 | Stacy | 100/51 |
| 3,142,105 | A | * | 7/1964 | Weir et al. | 425/62 |
| 3,225,409 | A | * | 12/1965 | Huffaker | 425/209 |
| 3,659,979 | A | * | 5/1972 | Schneider et al. | 425/62 |
| 3,736,084 | A | * | 5/1973 | Mitchell | 425/78 |
| 3,736,085 | A | * | 5/1973 | Mitchell | 425/78 |
| 4,164,537 | A | * | 8/1979 | Drostholm et al. | 264/333 |
| 4,579,706 | A | * | 4/1986 | Elkins | 264/124 |
| 4,640,671 | A | * | 2/1987 | Wright | 425/149 |
| 4,719,070 | A | * | 1/1988 | Strobel et al. | 264/319 |
| 4,725,216 | A | * | 2/1988 | Foster | 425/200 |
| 6,224,359 | B1 | * | 5/2001 | Domazet | 425/62 |
| 6,347,931 | B1 | * | 2/2002 | Underwood | 425/62 |
| 2003/0082258 | A1 | * | 5/2003 | Henderson | 425/354 |

FOREIGN PATENT DOCUMENTS

| | | | | |
|---|---|---|---|---|
| GB | 2087785 A | * | 6/1982 | B28B/3/12 |
| JP | 02-308730 A | * | 12/1990 | A01G/9/10 |

* cited by examiner

*Primary Examiner*—Michael Colaianni
*Assistant Examiner*—Michael I. Poe

(57) ABSTRACT

A portable single station method and apparatus for compressing a quantity of freshly dug soil into building blocks by an enclosed system which provides a linear process for receiving and compressing the quantity of soil and for ejecting the formed, compressed building blocks. The system includes a stationary chamber equipped with an internal adjustable cavity in which the desired block is formed and a pair of opposing pressure heads capable of moving toward and away from each other in unison or independently to receive, compress, and eject the building blocks.

12 Claims, 7 Drawing Sheets

TANGO II SOIL BLOCK PRESS

This application claims the benefit of Provisional application No. 60/266,371 filed Feb. 5, 2001

FIELD OF THE INVENTION

This invention relates to a linear self-enclosed apparatus for compressing freshly dug soil into compressed blocks suitable for the creation of a structure.

BACKGROUND OF THE INVENTION

The formation of building blocks from soil and clay is a well known process utilized throughout the world. Throughout the years various applications designed to automate this process have been produced. Previously designed apparatus, however, have involved complex mechanical procedures. A need exists for a design and process in which building blocks of different sizes and thickness can be formed simultaneously. An additional need exists for a design which allows for two or more systems to be joined and operated simultaneously or independently, while maintaining an easy access to replaceable components.

Examples of previous known form of presses similar to the present invention are disclosed in U.S. Pat. Nos. 4,640,671; 6,224,359.

SUMMARY OF THE INVENTION

The main objective of this invention is to provide a new and improved linear building block forming apparatus which is self-contained and capable of receiving a quantity of soil, forming building blocks of adjustable dimensions uniformly, and ejecting said blocks within a single multiple function case.

It is also an object of the invention to provide a new and improved linear building block forming process that is linear and contained within a multiple purpose case.

It is also an object of the invention to provide a new and improved linear building block forming process in which opposing compression heads are moved toward and away from one another with the purpose of receiving an adjustable quantity of soil, moving said soil, compressing said soil into a block and ejecting a compressed soil block.

It is also an object of the invention to provide a new and improved linear building block forming process in which opposing compression heads are moved toward and away from one another by any mechanical means.

It is therefore an object of the invention to provide a new and improved linear building block forming apparatus that may be mounted on a trailer chassis and may be towed to the site of construction.

It is another object of the invention to provide a new and improved linear building block forming apparatus that will create building blocks of different plan sizes utilizing a heavy textured clay, preferably without any addition of moisture or binder material with minimal skill or effort from the operator.

It is the objective of the invention to provide a new and improved linear building block forming apparatus that will compress the soil under high pressure to produce a building block so dense when ejected from the multiple function case that it will be instantly ready for use and need not be cured before use.

It is a further object of the invention to provide a new and improved linear building block forming apparatus that is modular in nature to allow for the addition of one or more multiple function cases, which may be controlled simultaneously or independently.

It is therefore also an object of the invention to provide a new and improved linear building block forming apparatus that is modular in nature to allow for higher production yields or to allow for production of blocks of different dimensions simultaneously or independently.

It is also an objective of the invention to provide a new and improved linear building block forming apparatus that produces uniform blocks dimensionally of adjustable sizes, which can be used to construct a structure by progressively dampening the upper course of the structure with water or light mud slurry, and placing the next course directly on top of this course.

It is still another object of the invention to provide a new and improved linear building block forming apparatus that is of durable construction.

It is also another object of the invention to provide a new and improved linear building block forming apparatus that requires low maintenance and is easily serviced.

It is yet another object of the invention to provide a new and improved linear building block forming apparatus that can be assembled and operated with a minimal of skill and attention.

It is still a further object of this invention to provide a new and improved linear building block forming apparatus that loads soil into the soil receiving area of the multiple function case efficiently and in a more compacted state by the use of a high-frequency vibration apparatus mounted directly to the soil receiving hopper.

These and other advantages, features and objects of the invention will become more apparent from the following description taken in connection with the illustrative embodiment in the accompanying drawings.

DESCRIPTION OF THE PREFERRED EMBODIMENT

Figure 1:
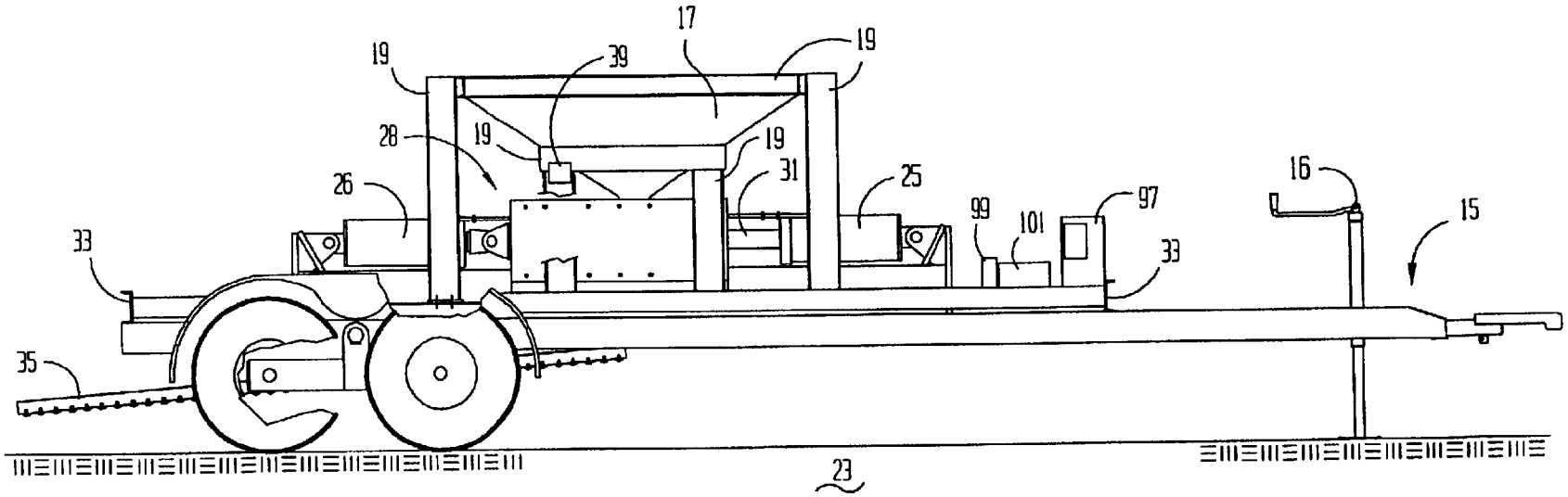
FIG. 1 is a side lateral view of a four wheel mounted trailer form of the instant invention.

Referring now more specifically to the drawings, the numeral 15 generally designates a trailer frame which may be towed behind a towing vehicle (not shown) and which includes a pair of wheeled axle assemblies 21 and 22 on its rear end as well as a jack structure 16. The jack structure 16 may be utilized in order to stationarily support the trailer frame 15 from the ground 23.

The trailer frame 15 supports a case support frame 33, a hydraulic tank 29, a programmable logic control (PLC) unit 95, a control panel 97, a hydraulic pump 99, an electrical motor 101, a pair of roller conveyors 35, as well as a hopper support frame 19.

Figure 4:
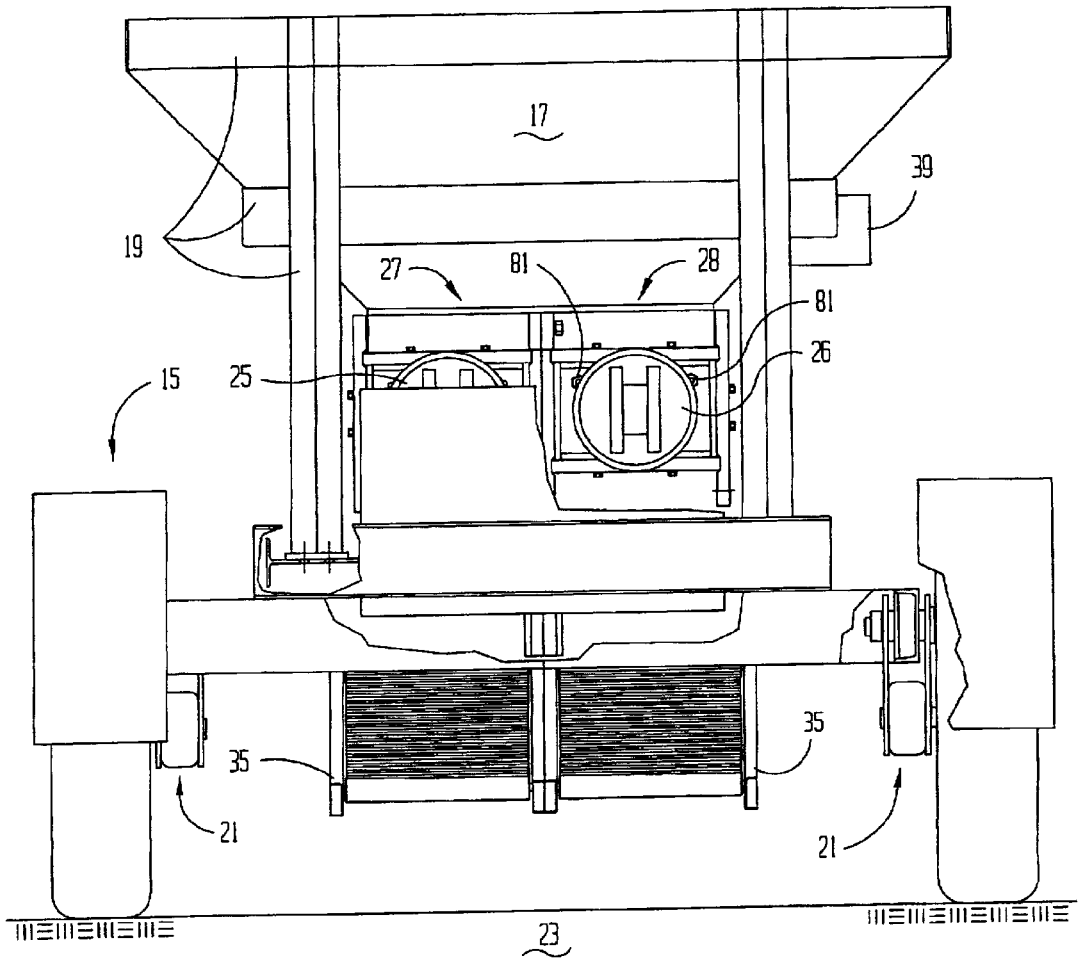
FIG. 4 is a partially fragmented rear view of the invention mounted atop a four wheeled trailer chassis.

As seen in FIGS. 1 and 4, the hopper support frame 19 contains the soil hopper 17 positioned above the pair of multiple function cases 27 and 28, in a stationary position.

Said soil hopper 17 is supported by a pair of braces 43 about its discharge area.

Figure 2:
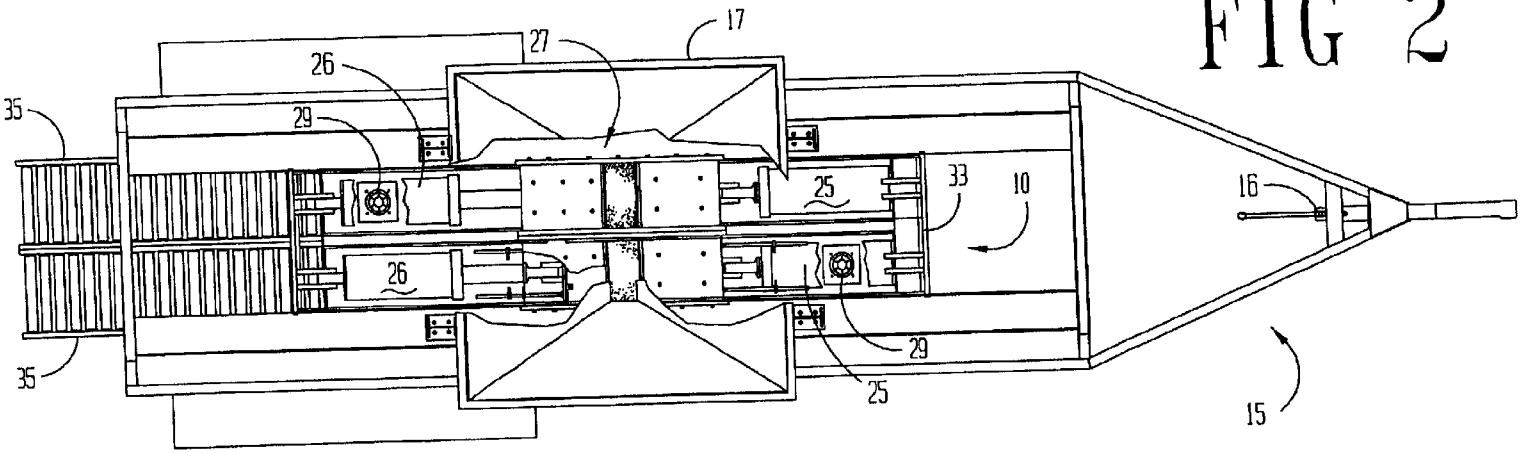
FIG. 2 is a top view of the invention mounted atop a four wheeled trailer chassis in which the soil hopper and a pair of hydraulic actuators have been fragmented to illustrate the multiple function case.

The case support frame 33 supports a pair of multiple function cases 27 and 28, each with a pair of hydraulic actuators 25 attachable at a point generally referred to by the numeral 37 as seen in FIGS. 2 and 4.

Figure 3:
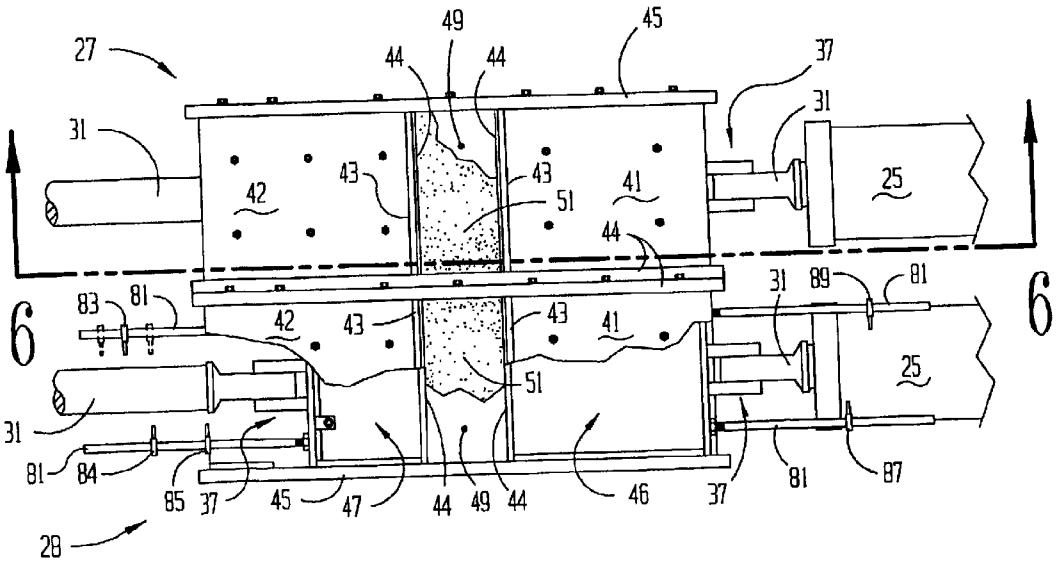
FIG. 3 is a partially fragmented top view of the multiple function case in which the compression heads and hydraulic actuators are more clearly illustrated.
Figure 5:
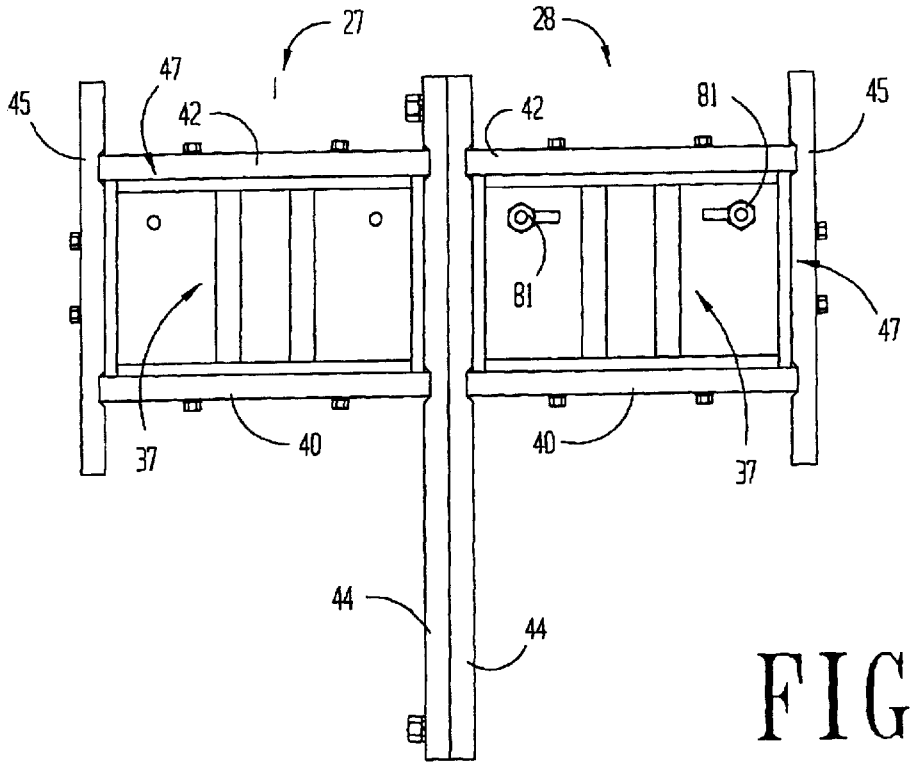
FIG. 5 is a rear lateral view of the invention showing a pair of multiple function cases, in which one contains a positioning control apparatus, which have been joined together about their corresponding connecting panels.

The multiple function cases 27 and 28 are representative of a possible combination whereby both cases will function in unison to create compressed soil blocks uniform in size, thickness, and density (See FIG. 3). As illustrated in FIG. 5, the multiple function cases 27 and 28 are symmetrical about their connecting panels 44.

Figure 6:
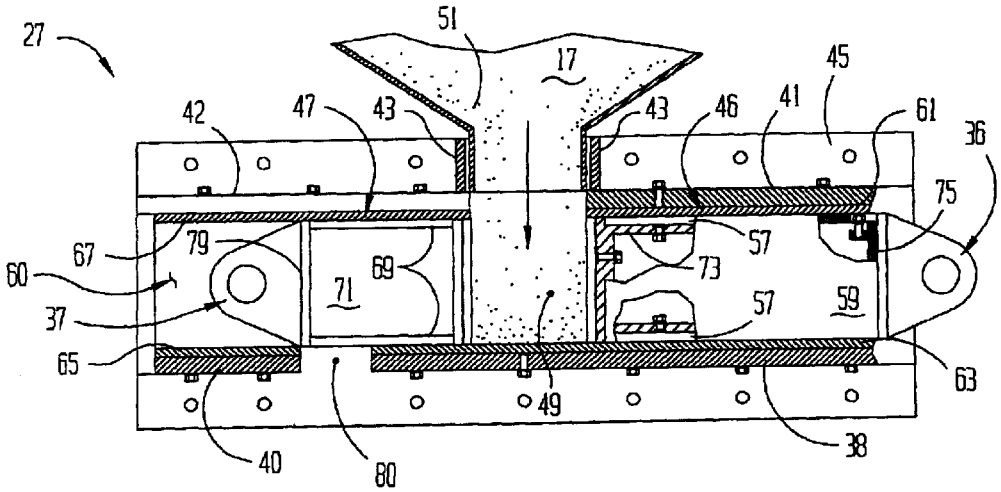
FIG. 6 is a sectional view taken about line 6—6 in FIG. 3 showing the locations and positions of the soil hopper, adjustable compression heads and their components, multiple function case and its components, and loose soil prior to compaction.

As is illustrated in FIGS. 3, 5 and 6, the multiple function cases, 27 and 28, are composed of compression heads, generally designated by numerals 46 and 47, side cover panels 45, connecting panels 44, upper covers 41 and 42 and lower covers 38 and 40. As can be seen in the previously mentioned FIGS., the upper covers 41 and 42, along with bottom covers 38 and 40 and panels 44 and 45 are joined to form an enclosed area. Said enclosed area contains two apertures designated by numerals 48 and 80. It is within said enclosed area that a compression case area, generally designated by numeral 60 is formed. Within said compression case area 60 compression case wear plates 61, 63, 65 and 67 are mounted securely. Said wear plates are to be constructed of a hardened steel alloy capable of withstanding high abrasion.

As illustrated in FIGS. 3 and 6, the compression heads 46 and 47 are comprised of compression head frames 73 and 77. Compression head wear plates 57, 59, 69 and 71 are securely mounted to said compression head frames as illustrated. Said wear plates are to be constructed of a hardened steel alloy capable of withstanding high abrasion.

The compression heads 46 and 47 are introduced within the compression case area 60 at opposite ends of said compression case and are secured by rear compression head plates 75 and 79 as seen in FIG. 6. As can be seen in FIG. 3, the rear compression head plates 75 and 79 are then attached to the hydraulic actuators 25 and 26 by means of actuator rods 31 and 32 at connection points generally designated by numerals 36 and 37, respectively.

In reference to FIGS. 1, 3 and 6, as soil 51 is loaded into the soil hopper 17 by manual or mechanical means. At commencement of the "first stage" of operation, a high-frequency vibration apparatus 39 increases the force by which loose soil 51 passes downwardly through said soil hopper 17 and into an adjustable soil receiving area 49. The downward force of the soil, aided by gravity and said vibration apparatus will uniformly fill and compact soil in said receiving area. At a preset interval of time the first stage of operation terminates as the PLC system 95 will disengage the high-frequency vibration apparatus 39.

Figure 7:
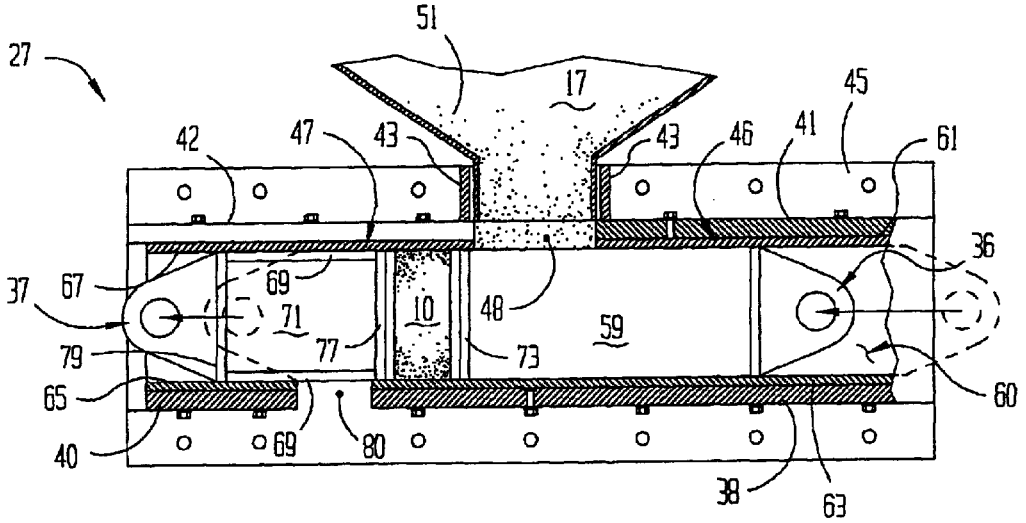
FIG. 7 is a partially fragmented side lateral view of the multiple function case showing the movement and positions of the compression heads, multiple function case and its components, compressed soil block and loose soil at compaction.

As can be seen in FIG. 3, during the initial process, anterior hydraulic actuators 25 will be in fully retracted positions, while posterior hydraulic actuators 26 will be fully extended. Said actuators are coupled to anterior 46 and posterior 47 compression heads at connection points generally designated by numeral 37. The positions of said actuators and respectively, said compression heads hereby aid in forming a soil receiving area 49, which is adjustable in accordance to the positions of said compression heads within the compression case area 60. In reference to FIG. 7, as the "second stage" of operation begins, both anterior and posterior hydraulic actuators (not shown) engage the anterior compression head 46 and posterior compression head 47. Said compression heads travel to preset destinations as shown in FIG. 7. As is illustrated in FIG. 7, the posterior compression head 47 will stop and remain stationary, as the anterior compression head 46 remains engaged. Thus, the "third stage" of operation begins. As the anterior compression head 46 travels within the compression case area 60 towards the posterior compression head 47 the soil 51 between said compression heads will become compacted further, until a block of compacted soil 10 is formed between said heads.

Figure 9:
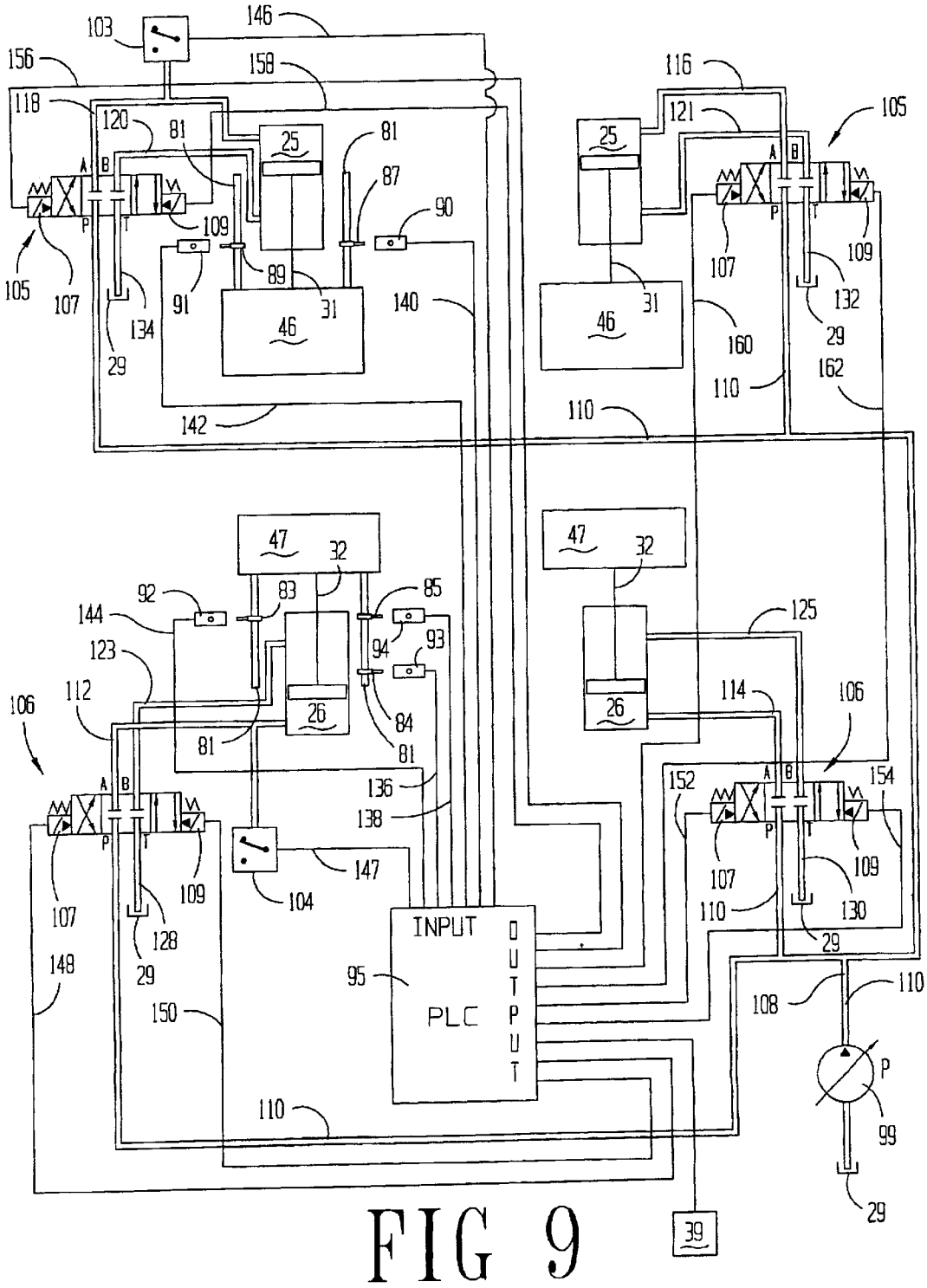
FIG. 9 is a fragmentary diagrammatic view illustrating the manner in which the hydraulic actuators may be controlled for the purpose of achieving desired compression between compression heads.
Figure 10:
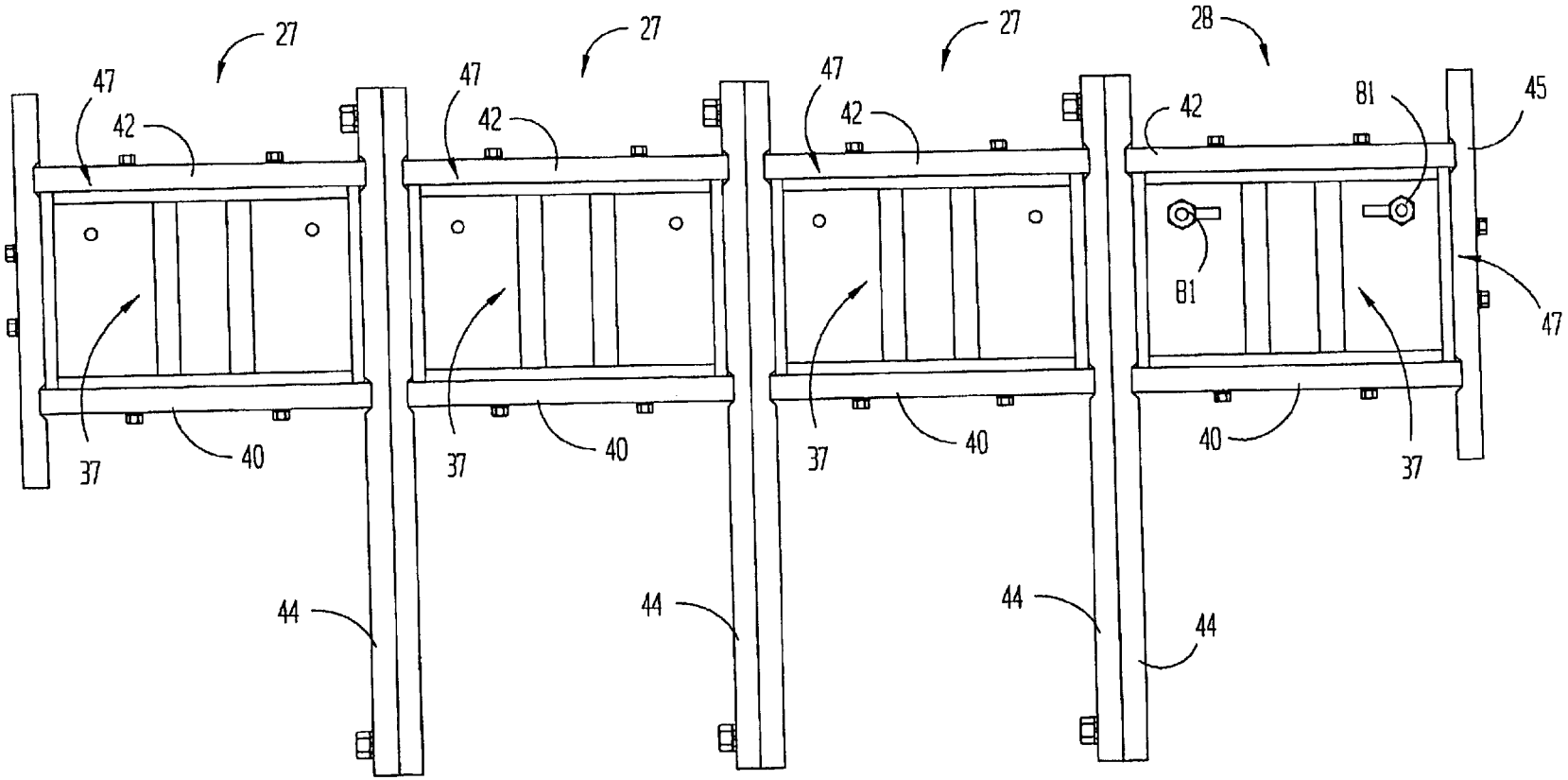
FIG. 10 is a rear lateral view of the invention showing a plurality of multiple function cases, in which one contains a positioning control apparatus, which have been joined together about their corresponding connecting panels.

In reference to FIGS. 7 and 9, the compression of the soil 51 between said compression heads will create a rise in hydraulic pressure in hydraulic line 118. When an initial preset pressure is reached in said hydraulic line, an adjustable pressure switch 103 will engage, and the PLC unit 95 will actively engage valve assembly 106 to increase pressure in hydraulic line 112. Hence, the posterior hydraulic actuator (not shown) will be engaged along with the posterior compression head 47 to travel towards the anterior compression head 46. The dual compression of said compressed soil block will continue to elevate hydraulic pressure within hydraulic lines 112 and 118. Upon reaching an optimal preset compression pressure in said hydraulic lines the adjustable pressure switch 104 will engage, and the PLC unit 95 will actively engage valve assembly 106 to disengage pressure in hydraulic line 112, thus diverting the hydraulic pressure to hydraulic line 120.

Figure 8:
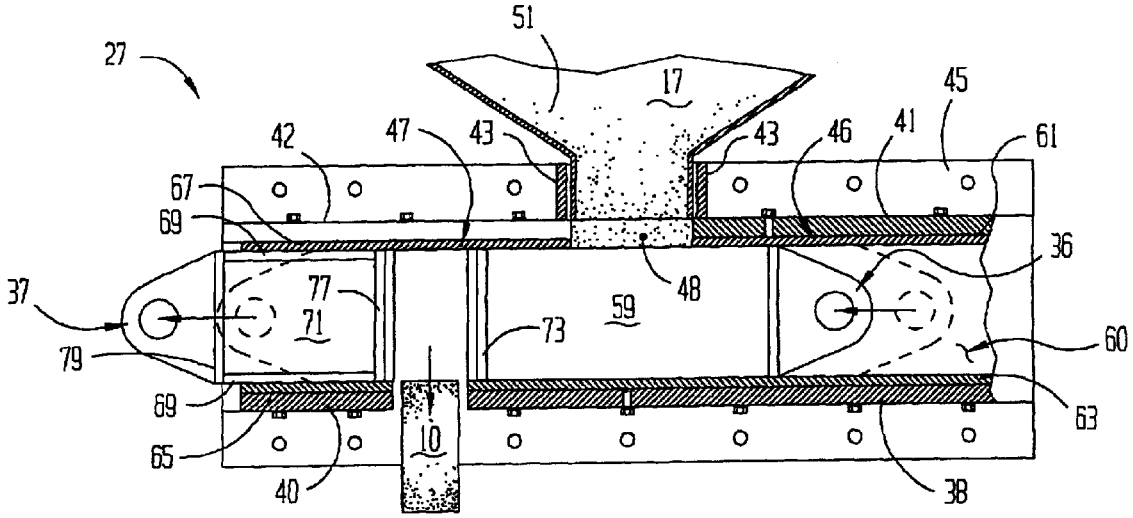
FIG. 8 is a partially fragmented side lateral view of the multiple function case showing the movement and positions of the compression heads, multiple function case and its components, compressed soil block and loose soil at the moment the compressed soil block is ejected from the multiple function case.

As illustrated on FIG. 8, whereas a compressed soil block 10 has been successfully formed within the compression case area 60 by utilizing opposing compression heads 46 and 47, the "fourth stage" of operation commences. As the posterior hydraulic actuator (not shown) retracts, the posterior compression head 47 is withdrawn to the position illustrated in FIG. 8. As the anterior hydraulic actuator (not shown) continues through the compression case area 60, the anterior compression head forces the compressed soil block 10 into the block discharge area 80. Subsequent to the completion of a fill operation, the discharged compressed soil block 10 will exit the invention. FIG. 8 generally illustrates the completion of the "fourth stage" of operation, and more specifically, the general locations of compression heads 46 and 47. Whereas the "fourth stage" is completed, the hydraulic actuators 25 and 26 will return to their original 'base' positions. The PLC unit 95 will then re-engage the high-frequency vibrating apparatus 39.

With attention now invited more specifically to FIG. 9, it may be seen that the hydraulic actuators 25 and 26 are serially connected within a hydraulic circuit 108 including a pump 99 for pumping hydraulic fluid from a reservoir 29, to the actuators 25 and 26 and then back to the reservoir 29. The hydraulic circuit 108 includes valve assemblies 105 and 106 serially connected therein and the valve assemblies 105 and 106 are under the control of a pair of solenoids 107 and 109 actuated by output conductors 148, 150, 152, 154, 156, 158, 160 and 162, from a PLC unit 95. A plurality of proximity switches 90, 91, 92, 93 and 94 are mounted stationary relative to the compression heads 46 and 47 and corresponding proximity switch actuators 83, 84, 85, 87 and 89 are adjustably mounted on the positioning control apparatus 81. In addition, adjustable pressure switches 103 and 104 are communicated with circuits 105 and 106 on the side thereof pressurized to extend the actuator rods 31 and 32. The proximity switches 90, 91, 92, 93 and 94 and pressure switches 103 and 104 are supplied current from a supply (not shown) and are connected to a PLC unit 95. The pressure switches 103 and 104 including their own output lines 146 and 147, respectively, comprising an input to PLC unit 95. Similarly, the proximity switches 90, 91, 92, 93 and 94 including their own output lines 140, 142, 144, 136 and 138, respectively, comprising an input to PLC unit 95.

The valves 105 and 106, actuated by the PLC unit 95 through output lines 148, 150, 152, 154, 156, 158, 160 and 162, are operable to connect the output line 110 from the pump 99 to either the input lines 112, 114, 116 and 118 for extending the actuator rods 31 and 32 or lines 120, 121, 123 and 125 for retracting the actuator rods 31 and 32. Of course, if the output line 110 from the pump 99 is communicated with lines 112, 114, 118 and 120, lines 120, 121, 123 and 125 are communicated with the return lines 128, 130, 132 and 134 to the reservoir 29. On the other hand, if the line 110 is communicated with lines 120, 121, 123 and 125, lines 112, 114, 118 and 120 are communicated with the 128, 130, 132 and 134 to the reservoir 29.

By removing the individual compression heads 46 and 47 from the compression case area 60, individual working components of the apparatus may be readily renewed, if desired. Further, by utilizing variations of the compression case area 60 and compression heads 46 and 47, the size and shape of the compressed soil blocks 10 to be formed may be varied.

Mounted on the frame are two support frames, 19 and 33, which support the hopper 17 and multiple function cases generally designated by the numeral 27.

As soon as the compressed soil block 10 is discharged onto the conveyor 35, it is ready to use in the building process. With the use of the apparatus as depicted, the operator only has two tasks: first, to place soil into the hopper 17, and second, to assemble the compressed soil blocks 10 into a structure.

The blocks 10 should be laid flat. After a course of blocks 10 has been laid, the upper flat surfaces of the blocks may be sprayed with water or mud slurry, so as to be slightly moistened when the next course of blocks is placed on it.

The embodiment of the invention as depicted can be summarized as follows. A plurality of linear multiple function cases. 27 and 28, each having a soil receiving area 49. The soil receiving area 49 is open vertically to the sky. The compression heads, 46 and 47, are positioned as to provide the lateral walls within the soil receiving area 49. The hopper 17 containing pre-granulated soil is mounted stationary above multiple function cases 27 and 28. Mounted along the frame of the hopper is a vibration apparatus 39 which, when in operation along with gravity, feeds granulated soil into the soil receiving area 49 and in doing so, maximizing the soil density. This is most important for the production of high quality uniform building blocks.

When the hopper has filled the soil receiving area 49 the hydraulic actuators are activated, and the compression heads, 46 and 47, move the soil within the multiple function case to its intended second stage location. It is at this second stage that the posterior compression head 47 remains in a fixed position momentarily while the anterior compression head 46 remains engaged and begins to lightly compact the soil 51.

The soil compression process is completed during the third stage whereas the posterior compression head 47 is re-engaged to travel in the direction of the anterior compression head 46. Simultaneously, the anterior compression head 46, continues to press the soil in its travel towards the posterior compression head 47. Hence, with the combined forces and relative applied pressure to the soil between said compression heads, the lightly compacted soil is compressed into a high density compressed soil block 10.

During the following fourth stage, both compression heads, 46 and 47, are moved within the multiple function cases, 27 and 28 toward the block discharge area 80, at which the finished compressed soil block 10 falls away free of the trailer 15 and onto a conveyor system 35 for use.

The apparatus mounted on a heavy frame suitable to sustain the hydraulic forces of the hydraulic actuators 25 and 26 and compression heads, 46 and 47.

While there is shown and described herein certain specific structure embodiments in the invention, it may be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method for the efficient forming of building blocks that are uniform in size and design from freshly dug soil by a self-enclosed linear process of receiving, moving, and compressing a quantity of soil to form said building blocks and ejecting said building blocks comprising:

controlling said size and design of said building blocks formed by said self-enclosed linear process using a programmable controller and operable mechanical means;

introducing said quantity of soil into a casing through a first aperture in an upper surface of said casing, wherein said casing comprises a plurality of sides and an enclosed cavity of adjustable dimensions, said cavity having two opposing faces formed from two opposing sides of said casing, wherein said two opposing sides are adjustable within the remaining sides of said casing for adjusting said dimensions of said cavity;

displacing said quantity of soil through said cavity in said casing to an area of compression within said casing by moving said two opposing sides;

compressing said quantity of soil within said casing between said two opposing sides by reducing said dimensions of said cavity to form said building blocks;

displacing said building blocks after compression to an ejection area within said casing by moving said two opposing sides; and ejecting said building blocks from the bottom of said casing through a second aperture in a lower surface of said casing by allowing said building blocks to fall downwardly through gravity by increasing said dimensions of said cavity.

2. Method of claim 1, wherein said opposing faces of said cavity are moved by said operable mechanical means.

3. Method of claim 1, wherein said opposing faces of said cavity are controlled by an operable command means of said programmable controller, which command said opposing faces during said introducing, displacing, compressing and ejecting steps.

4. Method of claim 1, wherein said quantity of soil is introduced into said casing by a vibration means.

5. An apparatus for efficient forming of building blocks that are uniform in size and shape from freshly dug soil comprising:

a casing having a plurality of sides, said casing comprising at least one first aperture in an upper surface of said casing for the introduction of a quantity of soil, at least one second aperture in a lower surface of said casing for the ejection of said building blocks, and an enclosed cavity of adjustable dimensions defined by said plurality of sides, wherein two opposing sides of said casing are adjustable within the remaining sides of said casing for adjusting said dimensions of said cavity, said two opposing sides of said casing traveling within the entirety of said casing and creating sufficient pressure against one another for the compression of said quantity of soil;

means for compressing said quantity of soil within said casing to specific pressures between said two opposing sides to form said building blocks;

means for moving said two opposed sides within said casing between areas of introduction, compression and ejection within said casing;

means for ejecting said building blocks from the bottom of said casing through said at least one second aperture by moving said two opposing sides apart such that said building block falls downwardly by gravity after compression; and a programmable controller that controls said size and design of said building blocks by controlling said introduction, means for compressing, means for moving and means for ejecting whereby consistent compression is imposed on said quantity of soil.

6. Apparatus of claim 1, wherein the apparatus comprises a trailer which is wheeled, and mobile, and is of a size and nature such that it can be towed on roads, and can be maneuvered about a construction site.

7. Apparatus of claim 5, wherein the apparatus comprises a casing having six sides through which two opposing faces of said two opposing sides travel within said casing for the purpose of receiving, displacing, and compressing said quantity of soil and ejecting said building blocks.

8. Apparatus of claim 5, wherein the apparatus comprises a casing cylindrical in nature through which two opposing faces of said two opposing sides travel within said casing for the purpose of receiving, displacing, and compressing said quantity of soil and ejecting said building blocks.

9. Apparatus of claim 5, wherein the apparatus comprises a soil hopper.

10. Apparatus of claim 5, wherein a plurality of said casings are fastened to one another with the purpose of creating a higher volume of compressed building blocks simultaneously that are uniform in size and design.

11. Apparatus of claim 5, wherein a plurality of said casings of varying dimensions may be fastened to one another with the purpose of creating compressed building blocks simultaneously that are varied in size and design.

12. An apparatus for the efficient forming of building blocks that are uniform in size and design from freshly dug soil by a self-enclosed linear process of receiving, moving, and compressing a quantity of soil to form said building blocks and ejecting said building blocks comprising:

means for controlling said size and design of said building blocks formed by said self-enclosed linear process using a programmable controller and operable mechanical means;

means for introducing said quantity of soil into a casing through a first aperture in an upper surface of said casing, wherein said casing comprises a plurality of sides and an enclosed cavity of adjustable dimensions, said cavity having two opposing faces formed from two opposing sides of said casing, wherein said two opposing sides are adjustable within the remaining sides of said casing for adjusting said dimensions of said cavity;

means for displacing said quantity of soil through said cavity in said casing to an area of compression within said casing by moving said two opposing sides;

means for compressing said quantity of soil within said casing between said two opposing sides by reducing said dimensions of said cavity to form said building blocks;

means for displacing said building blocks after compression to an ejection area within said casing by moving said two opposing sides; and means for ejecting said building blocks from the bottom of said casing through a second aperture in a lower surface of said casing by allowing said building blocks to fall downwardly through gravity by increasing said dimensions of said cavity.

* * * * *